US008579485B2

(12) United States Patent
Hara

(10) Patent No.: US 8,579,485 B2
(45) Date of Patent: Nov. 12, 2013

(54) VEHICULAR LAMP

(75) Inventor: Ryosuke Hara, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 140 days.

(21) Appl. No.: 13/115,356

(22) Filed: May 25, 2011

(65) Prior Publication Data

US 2011/0292670 A1 Dec. 1, 2011

(30) Foreign Application Priority Data

Jun. 1, 2010 (JP) ..... 2010-125554

(51) Int. Cl.
*F21V 5/00* (2006.01)

(52) U.S. Cl.
USPC ..... 362/522; 362/327; 362/336

(58) Field of Classification Search
USPC ..... 362/311.02, 327, 334, 335, 336, 337, 362/338, 340, 520, 521, 522
See application file for complete search history.

(56) References Cited

U.S. PATENT DOCUMENTS

| | | | | |
|---|---|---|---|---|
| 2,015,235 | A * | 9/1935 | Rolph | 362/340 |
| 4,263,641 | A * | 4/1981 | Ferrero | 362/327 |
| 7,465,075 | B2 * | 12/2008 | Chinniah et al. | 362/336 |
| 2005/0152153 | A1 | 7/2005 | Amano | |

FOREIGN PATENT DOCUMENTS

| | | | |
|---|---|---|---|
| GB | 2069124 A | * | 8/1981 |
| JP | 2004-126422 A | | 4/2004 |
| JP | 2005-203111 A | | 7/2005 |

OTHER PUBLICATIONS

English abstract of JP2005203111 published on Jul. 28, 2005, espacenet Worldwide Database, 1 page.
English abstract of JP2004126422 published on Apr. 22, 2004, espacenet Worldwide Database, 1 page.

* cited by examiner

*Primary Examiner* — Y My Quach Lee
(74) *Attorney, Agent, or Firm* — Osha Liang LLP

(57) ABSTRACT

A vehicular lamp includes a light source disposed on an optical axis extending in a front-back direction of the vehicular lamp; and a reflector that reflects forward light from the light source. The reflector is formed by a translucent member including a plurality of optical elements disposed continuously in a radial direction of the optical axis. Each of the optical elements includes: a surface of incidence through which light from a light emission reference point in the light source is incident into the optical element and which refracts the light into a direction away from the optical axis, a reflective surface which internally reflects forward the light which is incident into the optical element through the surface of incidence, and a surface of emission through which the light internally reflected by the reflective surface is emitted forward from the optical element. The reflective surface of each of the optical elements is formed by a curved surface formed to allow generally an entirety of the light internally reflected by the reflective surface to reach the surface of emission of the optical element as substantially parallel light.

10 Claims, 8 Drawing Sheets

VEHICULAR LAMP

BACKGROUND OF INVENTION

1. Field of the Invention

The present invention relates to a vehicular lamp including a reflector formed by a translucent member.

2. Related Art

Most vehicular lamps include a light source disposed on an optical axis extending in the front-back direction of the lamp and a reflector that reflects forward light from the light source.

"Patent Document 1" and "Patent Document 2" describe such a vehicular lamp in which the reflector is formed by a translucent member.

In the reflector described in "Patent Document 1," a surface of incidence is formed on a portion of the rear surface of the translucent member in the proximity of the optical axis so as to surround the light source. A plurality of reflective surfaces are formed on a portion of the rear surface of the translucent member around the surface of incidence so as to be stepped in the radial direction of the optical axis. Surfaces of emission are formed on the front surface of the translucent member in front of the respective reflective surfaces.

In the vehicular lamp described in "Patent Document 1," light from the light source is incident into the translucent member forming the reflector through the surface of incidence, and internally reflected forward as generally parallel light by the reflective surfaces. The internally reflected light is then emitted forward through the surfaces of emission positioned in front of the reflective surfaces.

In the reflector described in "Patent Document 2," a plurality of surfaces of incidence and surfaces of emission are formed on the front surface of the translucent member so as to be stepped in the radial direction relative to the optical axis, and the rear surface of the translucent member is formed as a single flat surface.

In the vehicular lamp described in "Patent Document 2," light from the light source incident into the translucent member forming the reflector through each of the surfaces of incidence is internally reflected forward by the rear surface of the translucent member. The light is then emitted forward through the surfaces of emission positioned in front of, or on the outer circumferential side of, the reflective surface.

[Patent Document 1] Japanese Patent Application Laid-Open (Kokai) No. JP-A-2005-203111

[Patent Document 2] Japanese Patent Application Laid-Open (Kokai) No. 2004-126422

SUMMARY OF INVENTION

By using the translucent member described in "Patent Document 1" as the reflector for the vehicular lamp, it is possible to allow the translucent member to appear to brightly emit light even from its peripheral portion, in addition to enhancing the luminous flux utilization factor for the light from the light source.

However, in the translucent member described in "Patent Document 1," the light from the light source is incident into the translucent member through the surface of incidence formed to surround the light source, and then internally reflected forward by the reflective surfaces. Thus, the base end portion of the translucent member is significantly thick at a portion close to the optical axis.

Therefore, a sink mark tends to be generated during molding of the translucent member, which may hinder precise control of the light from the light source. If the base end portion of the translucent member is thick at a portion close to the optical axis, it may be difficult to increase the size of the reflector.

In the translucent member described in "Patent Document 2," the base end portion of the translucent member is not thick at a portion close to the optical axis. However, the plurality of surfaces of incidence and surfaces of emission are formed on the front surface of the translucent member so as to be stepped, and the rear surface of the translucent member is formed as a single flat surface, which may hinder precise control of the light from the light source.

One or more embodiments of the present invention provide a vehicular lamp including a reflector formed by a translucent member, that allows precise control of light from a light source and that facilitates an increase in size of the reflector, in addition to allowing the translucent member to appear to brightly emit light even from its peripheral portion.

One or more embodiments of the present invention devises the shape of the translucent member.

One or more embodiments of the present invention provide a vehicular lamp including a light source disposed on an optical axis extending in a front-back direction of the lamp and a reflector that reflects forward light from the light source, wherein the reflector is formed by a translucent member including a plurality of optical elements disposed continuously in a radial direction of the optical axis;

wherein each of the optical elements includes a surface of incidence through which light from a light emission reference point in the light source is incident into the optical element and which refracts the light into a direction away from the optical axis, a reflective surface which internally reflects forward the light which is incident into the optical element through the surface of incidence, and a surface of emission through which the light internally reflected by the reflective surface is emitted forward from the optical element; and wherein the reflective surface of each of the optical elements is formed by a curved surface formed to allow generally an entirety of the light internally reflected by the reflective surface to reach the surface of emission of the optical element as substantially parallel light.

The "vehicular lamp" is not limited to a particular type of vehicular lamp, and may refer to a tail lamp, a stop lamp, a clearance lamp, a high-mount stop lamp, or the like, for example.

The type of the "light source" is not specifically limited. For example, a light-emitting chip of a light-emitting diode, a light-emitting portion of a discharge bulb, a filament of a halogen bulb, or the like may be used.

The "light emission reference point" in the light source refers to the position of a point light source serving as a reference for optical path calculation. While the light emission reference point is typically the center of light emission of the light source, the light emission reference point may be a point other than the center of light emission in the light source or a point positioned away from the light source.

The material of the "translucent member" is not specifically limited as long as the translucent member is translucent. For example, the translucent member may be formed from a transparent synthetic resin, glass, or the like.

The reflective surface of each "optical element" is configured to allow generally the entirety of the light internally reflected by the reflective surface to reach the surface of emission of the optical element as generally parallel light. However, the surface of incidence of each optical element may be configured to allow the entirety of the light incident into the optical element through the surface of incidence to reach the reflective surface of the optical element, or to allow part of the light incident into the optical element through the surface of incidence to reach the reflective surface of an optical element adjacently on the outer circumferential side of the optical element via a coupling portion between the optical elements.

As long as the "reflective surface" of each optical element is configured to allow generally the entirety of the light internally reflected by the reflective surface to reach the surface of emission of the optical element as generally parallel light, the direction of the generally parallel light internally reflected by the reflective surface is not specifically limited.

As described in relation to the above configuration, in the vehicular lamp according to one or more embodiments of the present invention, the reflector, which reflects forward light from the light source disposed on the optical axis extending in the front-back direction of the lamp, is formed by the translucent member including the plurality of optical elements disposed continuously in the radial direction of the optical axis, and each of the optical elements includes the surface of incidence through which light from the light emission reference point in the light source is incident into the optical element and which refracts the light into a direction away from the optical axis, the reflective surface which internally reflects forward the light which is incident into the optical element through the surface of incidence, and the surface of emission through which the light internally reflected by the reflective surface is emitted forward from the optical element. Thus, the base end portion of the translucent member forming the reflector can be formed to be not very thick at a portion close to the optical axis.

Thus, it is possible to effectively suppress generation of a sink mark during molding of the translucent member, which allows precise control of the light from the light source. This also facilitates an increase in size of the reflector.

In the vehicular lamp according to one or more embodiments of the present invention, moreover, the reflective surface of each of the optical elements is formed by a curved surface formed to allow generally the entirety of the light internally reflected by the reflective surface to reach the surface of emission of the optical element as generally parallel light. Thus, in one or more embodiments, the following effects can be obtained.

That is, by allowing generally the entirety of the light internally reflected by the reflective surface of each of the optical elements to reach the surface of emission of the optical element, a one-to-one correspondence can be established between the reflective surface and the surface of emission of each of the optical elements. Thus, it is possible to allow the translucent member to appear to brightly emit light even from its peripheral portion, in addition to enhancing the luminous flux utilization factor for the light from the light source.

Moreover, the light internally reflected by each of the reflective surfaces is allowed to reach each of the surfaces of emission as generally parallel light, which allows precise control of the light emitted from the surface of emission.

According to one or more embodiments of the present invention described above, it is possible to provide the vehicular lamp including the reflector formed by the translucent member, that allows precise control of light from the light source and that facilitates an increase in size of the reflector, in addition to allowing the translucent member to appear to brightly emit light even from its peripheral portion.

In the above configuration, the reflective surface of each of the optical elements may be configured such that light internally reflected from an inner circumferential end edge of the reflective surface travels toward an inner circumferential end edge of the surface of emission of the optical element, and such that light internally reflected from an outer circumferential end edge of the reflective surface travels toward an outer circumferential end edge of the surface of emission of the optical element. With such a configuration, light emission control can be performed using the entire area of the surface of emission. This enhances the precision of the light emission control to a maximum.

In the above configuration, the surface of emission of each of the optical elements may be formed with a conical surface, a vertex of which is a point in the proximity of the light emission reference point, as a reference surface. With such a configuration, each of the surfaces of emission can be disposed with a maximum inclination toward the front of the lamp within a range in which the light from the light source does not directly reach the surface of emission. This facilitates optical design in which the reflective surface of each of the optical elements is formed by a curved surface formed to allow generally the entirety of the light internally reflected by the reflective surface to reach the surface of emission of the optical element as generally parallel light. This also facilitates optical design in which reflected light from the reflective surface of each of the optical elements is emitted from the surface of emission of each of the optical elements with a direction generally in parallel with the optical axis as a reference. In such a case, in addition, it is possible to allow the surface of emission of each of the optical elements to appear to brightly emit light as viewed from the front of the lamp.

In the above configuration, the reflector may be divided into a plurality of areas in the circumferential direction of the optical axis, and the plurality of optical elements forming the plurality of areas may be displaced from each other in the radial direction between adjacent areas. With such a configuration, it is possible to form the reflector as a single translucent member even if the thickness of coupling portions between the optical elements is set to be generally zero. This makes it possible to reduce the thickness of the translucent member to a minimum. By adopting such a configuration, the reflector can be provided with a sophisticated appearance.

In the above configuration, the lens which transmits the light from the light source while deflecting the light may be disposed in front of the light source, and the lens may be formed integrally with the reflector. With such a configuration, the luminous flux utilization factor for the light from the light source can be further enhanced. In this case, a coupling portion between the lens and the reflector may be formed as the cylindrical portion centered on the optical axis. With such a configuration, it is possible to facilitate optical path calculation for the light from the light source toward the reflector, and optical design for each of the optical elements.

Other aspects and advantages of the invention will be apparent from the following description, the drawings and the claims.

DETAILED DESCRIPTION

Hereinafter, embodiments of the present invention will be described with reference to the drawings. In embodiments of the present invention presented, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

Figure 1:
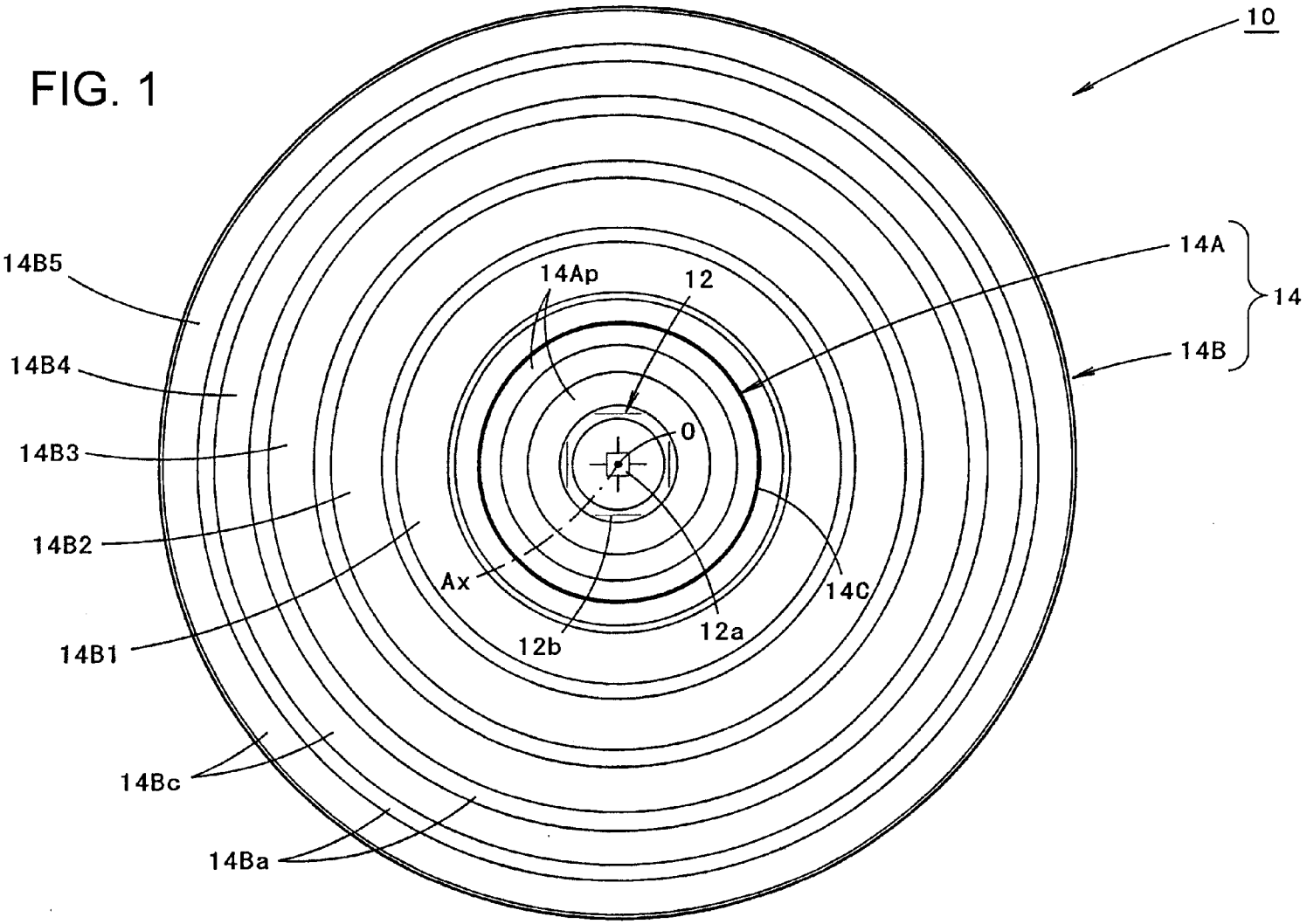
FIG. 1 is a front view showing a vehicular lamp according to one or more embodiments of the present invention.
Figure 2:
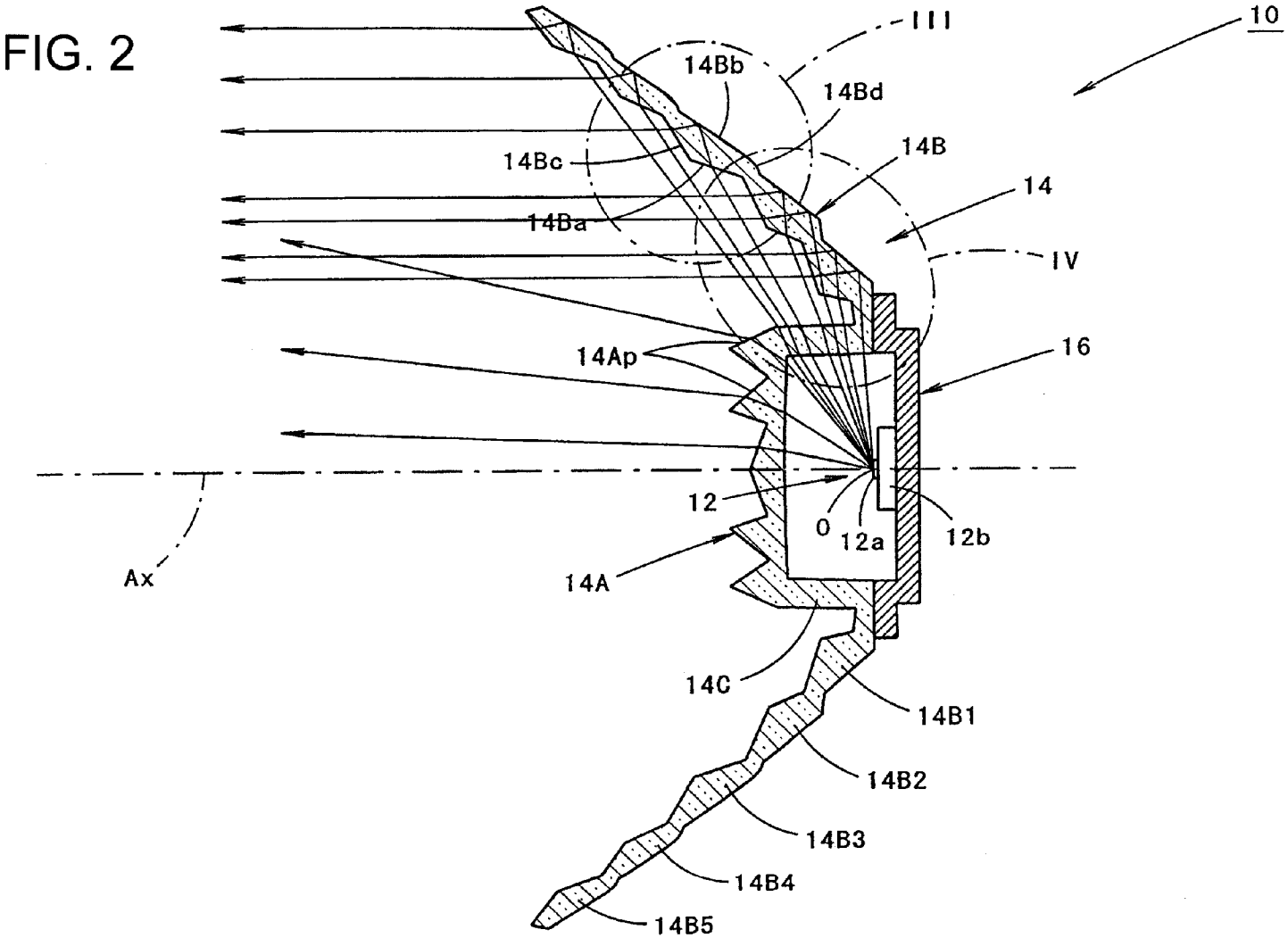
FIG. 2 is a side cross-sectional view showing the vehicular lamp shown in FIG. 1.

FIG. 1 is a front view showing a vehicular lamp 10 according to one or more embodiments of the present invention. FIG. 2 is a side cross-sectional view of the vehicular lamp 10.

As shown in the drawings, the vehicular lamp 10 according to one or more embodiments of the present invention may be a tail lamp disposed at the rear end portion of a vehicle. The vehicular lamp 10 includes a light-emitting element 12 and a translucent member 14, and has an optical axis Ax extending in the front-back direction of the vehicle.

The light-emitting element 12 is a red light-emitting diode including a light-emitting chip 12*a* serving as a light source and supported on a substrate 12*b*. The light-emitting element 12 is fixed to a supporting plate 16 with the light-emitting chip 12*a* facing toward the front of the lamp (toward the "rear" of the vehicle; the same applies hereinafter) on the optical axis Ax. The light-emitting chip 12*a* has a light-emitting surface with a size of about 0.3 to 1 mm square. A center of light emission O of the light-emitting surface is positioned on the optical axis Ax.

The translucent member 14 is a transparent synthetic resin molded article, and is disposed to cover the light-emitting element 12 from the front.

A portion of the translucent member 14 positioned in the proximity of the optical axis Ax (that is, a portion of the translucent member 14 positioned right in front of the light-emitting element 12) is formed as a lens 14A. The surrounding portion of the translucent member 14 is formed as a reflector 14B. The lens 14A is generally formed as a Fresnel lens. The reflector 14B is formed in a generally mortar shape. The lens 14A and the reflector 14B are coupled to each other via a cylindrical portion 14C.

The translucent member 14 is disposed such that the respective rear end surfaces of the reflector 14B and the cylindrical portion 14C are generally flush with the light-emitting surface of the light-emitting chip 12*a*. The translucent member 14 is fixed to the supporting plate 16 through the respective rear end surfaces of the reflector 14B and the cylindrical portion 14C.

A plurality of prism portions 14Ap extending annularly around the optical axis Ax are formed on the front surface of the lens 14A so as to be coaxial with each other. The lens 14A is configured to deflect light directly emitted from the light-emitting chip 12*a* to be incident on the lens 14A into a direction closer to the optical axis Ax through the prism portions 14Ap in order to emit the deflected light.

The cylindrical portion 14C is formed to extend rearward from the outer peripheral portion of the rear surface of the lens 14A and generally along a cylindrical surface centered on the optical axis Ax. The cylindrical portion 14C is formed to have a constant thickness.

The reflector 14B includes five optical elements 14B1 to 14B5 disposed continuously in the radial direction of the optical axis Ax.

Each of the optical elements 14B1 to 14B5 includes a surface of incidence 14Ba and a surface of emission 14Bc formed on the front surface of the translucent member 14, and a reflective surface 14Bb and a connection surface 14Bd formed on the rear surface of the translucent member 14.

In each of the optical elements 14B1 to 14B5, light from a light emission reference point in the light-emitting chip 12*a* is incident into the optical elements 14B1 to 14B5 through the surface of incidence 14Ba to be refracted into a direction away from the optical axis Ax. The light incident into the optical elements 14B1 to 14B5 through the surface of incidence 14Ba is internally reflected forward by the reflective surface 14Bb. The light internally reflected by the reflective surface 14Bb is emitted forward from the optical elements 14B1 to 14B5 through the surface of emission 14Bc.

The light emission reference point in the light-emitting chip 12*a* is set to a point in the proximity of the center of light emission O of the light-emitting chip 12*a*. Specifically, if the cylindrical portion 14C was not present, the light emission reference point would be set to the center of light emission O on the light-emitting surface of the light-emitting chip 12*a*. In practice, however, the cylindrical portion 14C is present, and the light directly emitted from the light-emitting chip 12*a* reaches each of the optical elements 14B1 to 14B5 via the cylindrical portion 14C. Thus, the light emission reference point is set to a point provided on an identical circumference centered on the optical axis Ax and slightly displaced from the center of light emission O because of the presence of the cylindrical portion 14C.

The surface of emission 14Bc of each of the optical elements 14B1 to 14B5 is formed by a part of a conical surface which is centered on the optical axis Ax and the vertex of which is a point in the proximity of the light emission reference point on the optical axis Ax. In this case, the light emission reference point is positioned on the conical surface. The surface of incidence 14Ba of each of the optical elements 14B1 to 14B5 is formed by a conical surface which is coaxial with the conical surface forming the surface of emission 14Bc of the optical elements 14B1 to 14B5 and the vertex angle of which is smaller than the vertex angle of the conical surface forming the surface of emission 14Bc. The reflective surface 14Bb of each of the optical elements 14B1 to 14B5 is formed by a curved surface formed to allow generally the entirety of the light internally reflected by the reflective surface 14Bb to reach the surface of emission 14Bc of the optical elements 14B1 to 14B5 as generally parallel light and to direct the light emitted through the surface of emission 14Bc generally in parallel with the optical axis Ax.

In one or more embodiments of the present invention, the internal reflection performed by the reflective surface 14Bb of each of the optical elements 14B1 to 14B5 is performed by total internal reflection (which will be discussed later).

Of the optical elements 14B1 to 14B5, three optical elements 14B3 to 14B5 on the outer circumferential side are configured similarly to each other. However, two optical elements 14B1 and 14B2 on the inner circumferential side are configured partly differently.

Thus, in the following, first, the specific shape of the curved surface forming the reflective surface 14Bb of the optical element 14B3, which is the third from the inner circumferential side, is described. Then, the two optical elements 14B1 and 14B2 on the inner circumferential side are described.

Figure 3:
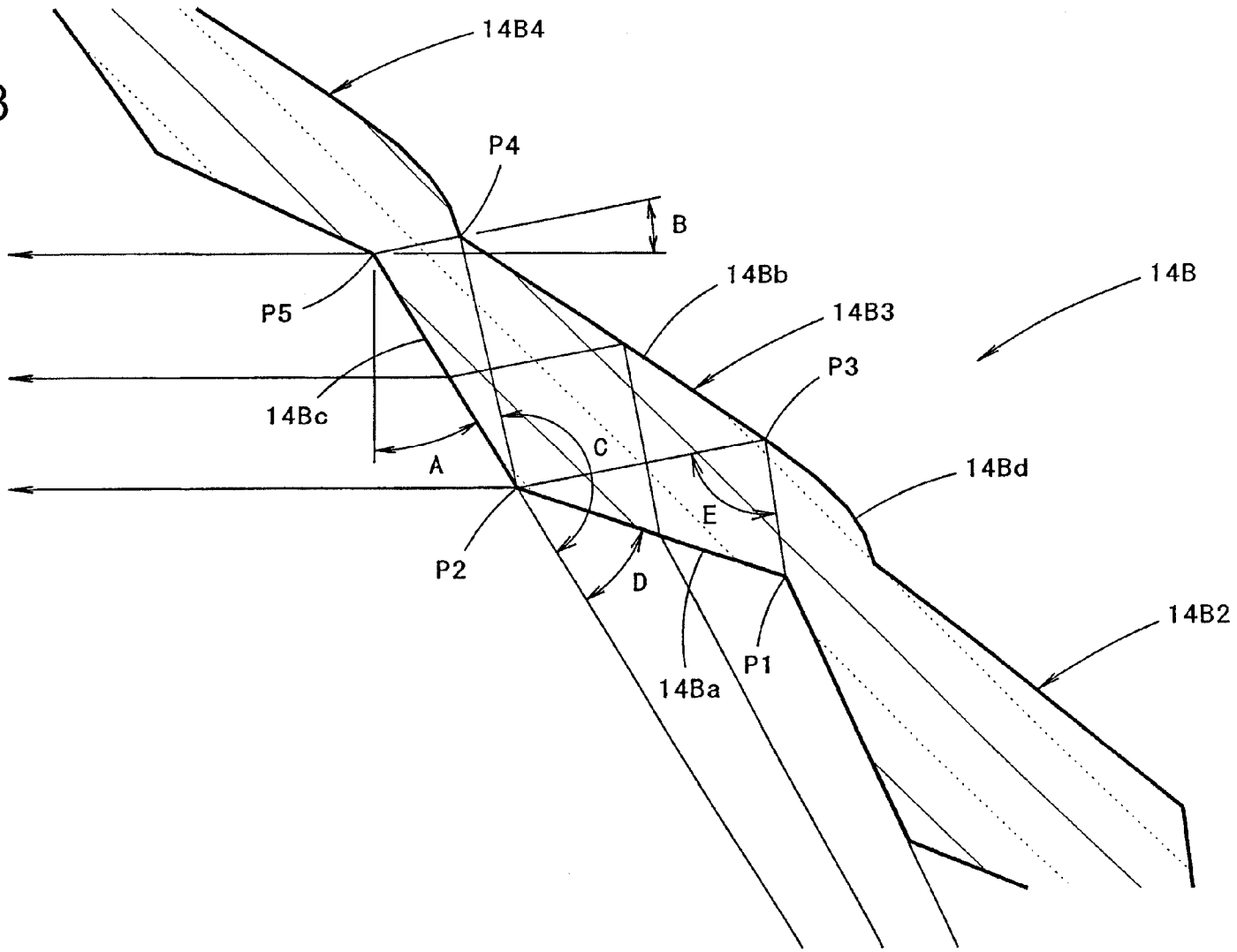
FIG. 3 is a detailed view of a part III in FIG. 2.

FIG. 3 is a detailed view of a part III in FIG. 2.

In the optical element 14B3, as shown in the drawing, points at the inner circumferential end edge and the outer circumferential end edge of the surface of incidence 14Ba are defined as P1 and P2, respectively. Points at the inner circumferential end edge and the outer circumferential end edge of the reflective surface 14Bb are defined as P3 and P4, respectively. A point at the outer circumferential end edge of the surface of emission 14Bc is defined as P5 (a point at the inner circumferential end edge of the reflective surface 14Bc is P2, which is the same as the point at the outer circumferential end edge of the surface of incidence 14Ba).

The angle formed between the line segment connecting the point P2 and the point P5 and a plane orthogonal to the optical axis Ax is defined as A. The angle formed between the line segment connecting the point P4 and the point P5 and a straight line parallel with the optical axis Ax is defined as B. The angle formed between the line segment connecting the point P2 and the point P4 and an extension of the line segment connecting the point P2 and the point P5 on the point P2 side is defined as C. The angle formed between the line segment connecting the point P1 and the point P2 and an extension of the line segment connecting the point P2 and the point P5 on the point P2 side is defined as D.

The cross-sectional shape of the surface of emission 14Bc of the optical element 14B3 taken in a plane including the optical axis Ax is formed by a straight line passing through the light emission reference point, and the light emitted through the surface of emission 14Bc is directed generally in parallel with the optical axis Ax. Thus, it is necessary to form the light reflected by the reflective surface 14Bb to reach the surface of emission 14Bc into generally parallel light directed with a slight inclination toward the optical axis Ax. Thus, when the index of refraction of the synthetic resin material forming the translucent member 14 is defined as n, the angle B is represented by the following formula (1):

$$B = \sin^{-1}\left(\frac{\sin A}{n}\right) \tag{1}$$

The cross-sectional shape of the surface of incidence 14Ba of the optical element 14B3 taken in a plane including the optical axis Ax is a straight line, and the light incident on the surface of incidence 14Ba is divergent light from the light emission reference point. Thus, the light incident into the optical element 14B3 through the surface of incidence 14Ba is refracted into a direction away from the optical axis Ax to reach the reflective surface 14Bb as divergent light.

In order to reflect the light having reached the reflective surface 14Bb as divergent light into a direction with a slight inclination toward the optical axis Ax as generally parallel light, the cross-sectional shape of the reflective surface 14Bb taken in a plane including the optical axis Ax is determined as follows.

With the position of the point P4 at the outer circumferential end edge of the reflective surface 14Bb set to a position at which the thickness for forming the reflector 14B as a part of the translucent member 14 is secured, the angle C for allowing the light from the light emission reference point and incident at the point P2 at the outer circumferential end edge of the surface of incidence 14Ba to reach the point P4 at the outer circumferential end edge of the reflective surface 14Bb is determined.

With the value of the angle C thus determined, the direction of a surface element in the proximity of the point P4 on the reflective surface 14Bb for reflecting the light incident at the point P2 at the outer circumferential end edge of the surface of incidence 14Ba toward the point P5 at the outer circumferential end edge of the surface of emission 14Bc is determined.

Also, the value of the angle D is determined from the value of the angle C by the following formula (2):

$$D = 90^{\circ} - \tan^{-1}\left(\frac{-n\sin C}{1 + n\cos C}\right) \tag{2}$$

The directions of surface elements at respective points on the reflective surface 14Bb for reflecting the light incident at respective points on the surface of incidence 14Ba toward respective points on the surface of emission 14Bc as generally parallel light are determined on the basis of the value of the angle D sequentially from a surface element in the proximity of the point P4 to a surface element in the proximity of the point P3 at the inner circumferential end edge of the reflective surface 14Bb. Thus, the cross-sectional shape of the reflective surface 14Bb taken in a plane including the optical axis Ax is determined as a parabolic free curve.

The point P3 at the inner circumferential end edge of the reflective surface 14Bb is set to a position at which the light from the light emission reference point and incident at the point P1 at the inner circumferential end edge of the surface of incidence 14Ba is reflected toward the point P2 at the inner circumferential end edge of the surface of emission 14Bc.

Of the light reflected by the reflective surface 14Bb, the angle of reflection is smallest for light reflected at the point P3 at the inner circumferential end edge of the reflective surface 14Bb. Thus, in order that the internal reflection performed by the reflective surface 14Bb is performed as total internal reflection, it is necessary that the angle E shown in FIG. 3 should be more than twice the critical angle of the translucent member 14 as represented by the following formula (3):

$$E > 2\sin^{-1}\left(\frac{1}{n}\right) \tag{3}$$

If the surface of emission 14Bc is extended to the inner circumferential end edge side, the value of the angle E can be accordingly increased. Thus, in the case where the angle E does not meet the formula (3) as a result of determining the cross-sectional shape of the reflective surface 14Bb taken in a plane including the optical axis Ax as a free curve, the surface of emission 14Bc may be extended to the inner circumferential end edge side to increase the width of the surface of emission 14Bc in the radial direction.

A portion of the rear surface of the optical element 14B3 on the inner circumferential side with respect to the reflective surface 14Bb is formed in the shape of a curved surface as the connection surface 14Bd. The connection surface 14Bd does not have an optical function, and is formed with an adequate thickness to connect the optical element 14B3 and the optical element 14B2 on the inner circumferential side.

Figure 4:
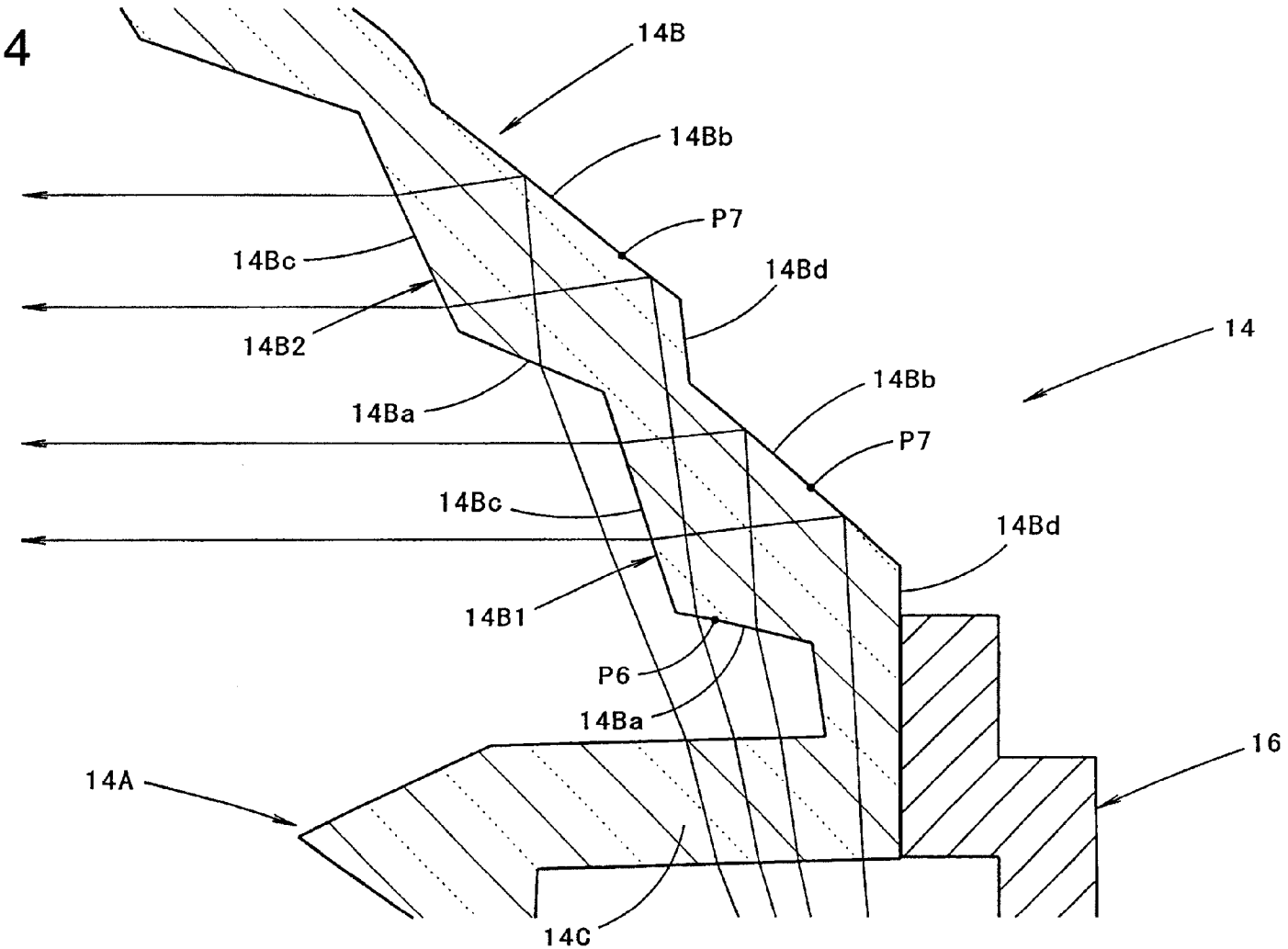
FIG. 4 is a detailed view of a part IV in FIG. 2.

FIG. 4 is a detailed view of a part IV in FIG. 2.

In the two optical elements 14B1 and 14B2 positioned on the inner circumferential side, as shown in the drawing, the reflective surface 14Bb is formed to extend to the inner circumferential side with respect to a point P7, which corresponds to the point P3 in FIG. 3, and the connection surface 14Bd is formed in the shape of a flat surface or a conical surface.

In the optical element 14B1 positioned on the innermost circumferential side, a portion of the surface of incidence 14Ba on the inner circumferential side with respect to a point P6, which is close to the outer circumferential end edge, is configured to refract the light incident on that portion of the surface of incidence 14Ba toward the reflective surface 14Bb of the optical element 14B1. A portion of the surface of incidence 14Ba on the outer circumferential side with respect to the point P6 is configured to refract the light incident on that portion of the surface of incidence 14Ba toward a portion of the reflective surface 14Bb of the optical element 14B2, which is adjacently on the outer circumferential side of the optical element 14B1, on the inner circumferential side with respect to the point P7.

The surface shape of the portion of the reflective surface 14Bb of the optical element 14B2, which is adjacently on the outer circumferential side of the optical element 14B1, on the inner circumferential side with respect to the point P7 is set such that the light internally reflected by that portion is directed generally in parallel with the light internally reflected by a portion of the reflective surface 14Bb on the outer circumferential side with respect to the point P7.

The optical element 14B1 positioned on the innermost side is configured such that the light incident into the rear end portion of the cylindrical portion 14C to reach the reflective surface 14Bb is internally reflected by a portion of the reflective surface 14Bb on the inner circumferential side with respect to the point P7.

The surface shape of the portion of the reflective surface 14Bb of the optical element 14B1 on the inner circumferential side with respect to the point P7 is set such that the light internally reflected by that portion is directed generally in parallel with the light internally reflected by a portion of the reflective surface 14Bb on the outer circumferential side with respect to the point P7.

In the vehicular lamp 10 according to one or more embodiments of the present invention, the reflector 14B, which reflects forward light from the light-emitting chip 12*a* disposed on the optical axis Ax extending in the front-back direction of the lamp, is formed by the translucent member 14 including the five optical elements 14B1 to 14B5 disposed continuously in the radial direction of the optical axis Ax, and each of the optical elements 14B1 to 14B5 includes the surface of incidence 14Ba through which light from the light emission reference point in the light-emitting chip 12*a* is incident into the optical elements 14B1 to 14B5 and which refracts the light into a direction away from the optical axis Ax, the reflective surface 14Bb which internally reflects forward the light which is incident into the optical elements 14B1 to 14B5 through the surface of incidence 14Ba, and the surface of emission 14Bc through which the light internally reflected by the reflective surface 14Bb is emitted forward from the optical elements 14B1 to 14B5. Thus, the base end portion of the translucent member 14 forming the reflector 14B can be formed to be not very thick at a portion close to the optical axis Ax.

Thus, it is possible to effectively suppress generation of a sink mark during molding of the translucent member 14, which allows precise control of the light from the light-emitting chip 12*a*. This also facilitates an increase in size of the reflector 14B.

In the vehicular lamp 10 according to one or more embodiments of the present invention, moreover, the reflective surface 14Bb of each of the optical elements 14B1 to 14B5 is formed by a curved surface formed to allow generally the entirety of the light internally reflected by the reflective surface 14Bb to reach the surface of emission 14Bc of the optical elements 14B1 to 14B5 as generally parallel light. Thus, the following effects can be obtained.

By allowing generally the entirety of the light internally reflected by the reflective surface 14Bb of each of the optical elements 14B1 to 14B5 to reach the surface of emission 14Bc of the optical elements 14B1 to 14B5, a one-to-one correspondence can be established between the reflective surface 14Bb and the surface of emission 14Bc of each of the optical elements 14B1 to 14B5. Thus, it is possible to allow the translucent member 14 to appear to brightly emit light even from its peripheral portion, in addition to enhancing the luminous flux utilization factor for the light from the light-emitting chip 12*a*.

Moreover, the light internally reflected by each of the reflective surfaces 14Bb is allowed to reach each of the surfaces of emission 14Bc as generally parallel light, which allows precise control of the light emitted from the surface of emission 14Bc.

According to one or more embodiments of the present invention described above, it is possible to provide the vehicular lamp 10 including the reflector 14B formed by the translucent member 14, that allows precise control of light from the light-emitting chip 12*a* and that facilitates an increase in size of the reflector 14B, in addition to allowing the translucent member 14 to appear to brightly emit light even from its peripheral portion.

In one or more embodiments of the present invention, the reflective surface 14Bb of each of the optical elements 14B1 to 14B5 is configured such that light internally reflected from the inner circumferential end edge of the reflective surface 14Bb travels toward the inner circumferential end edge of the surface of emission 14Bc of the optical elements 14B1 to 14B5, and such that light internally reflected from the outer circumferential end edge of the reflective surface 14Bb travels toward the outer circumferential end edge of the surface of emission 14Bc of the optical elements 14B1 to 14B5. With such a configuration, light emission control can be performed using the entire area of the surface of emission 14Bc. This enhances the precision of the light emission control to a maximum.

In one or more embodiments of the present invention, the surface of emission 14Bc of each of the optical elements 14B1 to 14B5 may be formed with a conical surface, the vertex of which is a point in the proximity of the light emission reference point, as a reference surface. With such a configuration, each of the surfaces of emission 14Bc can be disposed with a maximum inclination toward the front of the lamp within a range in which the light from the light-emitting chip 12*a* does not directly reach the surface of emission 14Bc. This facilitates optical design in which the reflective surface 14Bb of each of the optical elements 14B1 to 14B5 is formed by a curved surface formed to allow generally the entirety of the light internally reflected by the reflective surface 14Bb to reach the surface of emission 14Bc of the optical elements 14B1 to 14B5 as generally parallel light.

Further, the surface of emission 14Bc of each of the optical elements 14B1 to 14B5 is disposed with a maximum inclination toward the front of the lamp as described above. This facilitates optical design in which reflected light from the reflective surface 14Bb of each of the optical elements 14B1 to 14B5 is emitted from the surface of emission 14Bc of each of the optical elements 14B1 to 14B5 in a direction generally in parallel with the optical axis Ax as in one or more embodiments of the present invention. This makes it possible to allow the entire area of the surface of emission 14Bc of each of the optical elements 14B1 to 14B5 to appear to brightly emit light as viewed from the front of the lamp.

In one or more embodiments of the present invention, the lens 14A which transmits the light from the light-emitting chip 12*a* while deflecting the light is disposed in front of the light-emitting chip 12*a*, and the lens 14A and the reflector 14B are formed integrally with each other as the translucent member 14. Thus, the luminous flux utilization factor for the light from the light-emitting chip 12*a* can be further enhanced. In this case, moreover, a coupling portion between the lens 14A and the reflector 14B in the translucent member 14 is formed as the cylindrical portion 14C centered on the optical axis Ax. Thus, it is possible to facilitate optical path calculation for the light from the light-emitting chip 12*a* toward the reflector 14B, and optical design for each of the optical elements 14B1 to 14B5.

In one or more embodiments of the present invention, further, the internal reflection performed by the reflective surface 14Bb of each of the optical elements 14B1 to 14B5 is performed by total internal reflection. Thus, the above effect can be obtained without performing mirror finishing on the translucent member 14. This provides the reflector 14B with a crystal-like finish, which enhances the appearance of the vehicular lamp 10 when not lit.

In one or more embodiments of the present invention, the surface shape of a portion of the reflective surface 14Bb of each of the two optical elements 14B1 and 14B2, which are positioned on the inner circumferential side, on the inner circumferential side with respect to the point P7, which is closer to the inner circumferential end edge of the reflective surface 14Bb, is set such that the light internally reflected by that portion is directed generally in parallel with the light internally reflected by a portion of the reflective surface 14Bb on the outer circumferential side with respect to the point P7. This makes it possible to allow the entire area of the surface of emission 14Bc of each of the optical elements 14B1 and 14B2 to appear to brightly emit light, in addition to the fact that the internal reflection performed by the reflective surface 14Bb of each of the optical elements 14B1 and 14B2 is performed by total internal reflection.

In one or more embodiments of the present invention, the angle D is set to the value indicated by the formula (2). However, also in the case where the angle D is set to a value smaller than the value indicated by the formula (2), it is possible to allow the light incident into each of the optical elements 14B1 to 14B5 through the surface of incidence 14Ba to reach the reflective surface 14Bb.

In one or more embodiments of the present invention, the reflector 14B includes the five optical elements 14B1 to 14B5 disposed continuously in the radial direction of the optical axis Ax. However, advantages of one or more embodiments of the present invention may be obtained with a configuration in which four or less or six or more optical elements are disposed continuously.

Next, modifications of one or more embodiments of the present invention will be described.

First, a first modification of one or more embodiments of the present invention is described.

Figure 5:
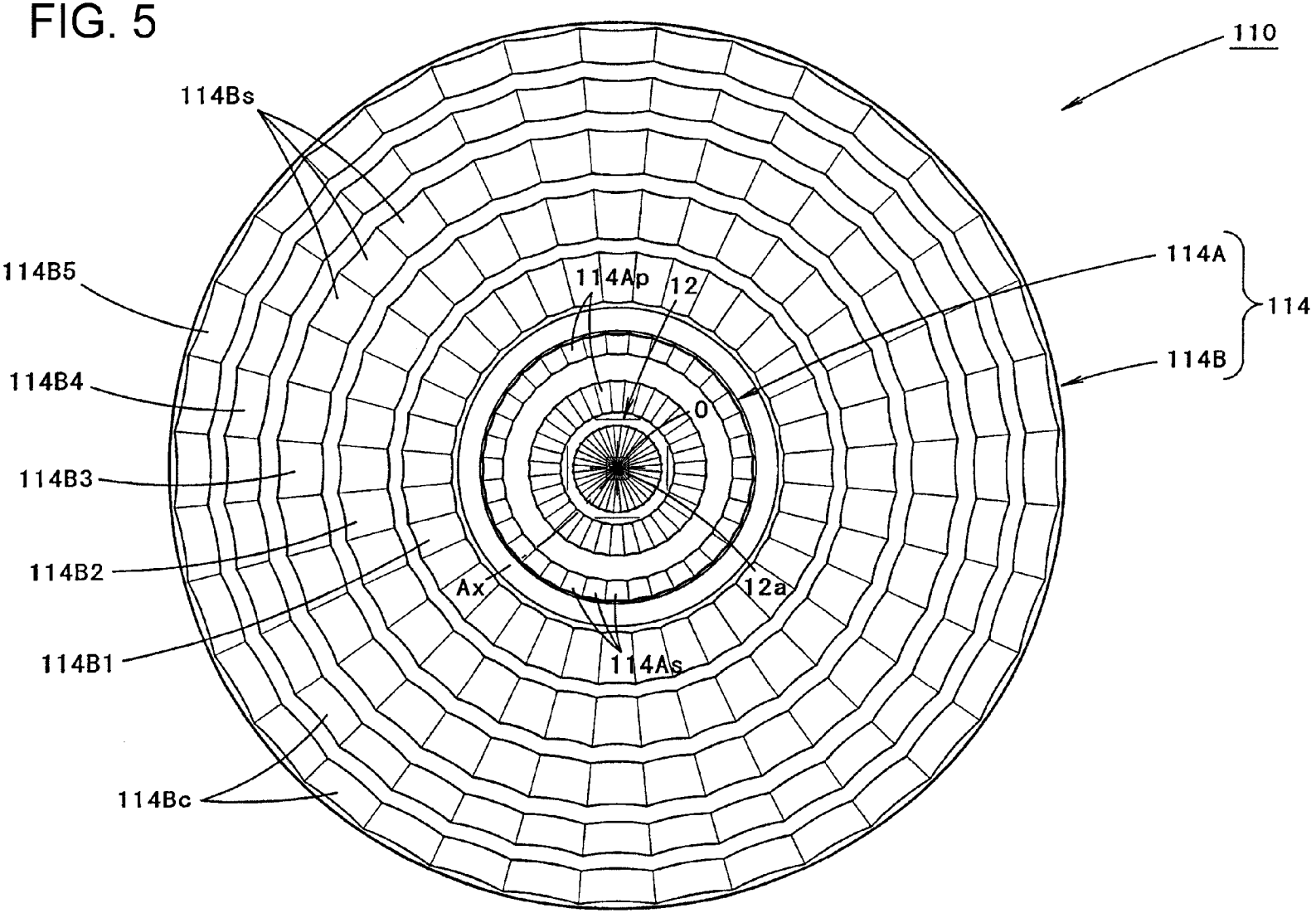
FIG. 5 is a front view showing a vehicular lamp according to a first modification of one or more embodiments of the present invention.

FIG. 5 is a front view showing a vehicular lamp 110 according to the first modification.

As shown in the drawing, the configuration of the vehicular lamp 110 is basically the same as that of the vehicular lamp 10 according to one or more embodiments of the present invention. However, the respective shapes of the front surface of a lens 114 and the front surface of a reflector 114B in a translucent member 114 are different from those according to one or more embodiments of the present invention.

That is, in the lens 114A according to the modification, each of prism portions 114Ap, which are formed on the front surface of the lens 114A so as to be coaxial with each other, is divided in the circumferential direction of the optical axis Ax into a plurality of segments. A diffusion lens element 114As is assigned to each of the segments. Each of the diffusion lens elements 114As is configured to diffuse light directly emitted from the light-emitting chip 12*a* to be incident on the lens 114A in the circumferential direction of the optical axis Ax in order to emit the diffused light.

In the reflector 114B according to the first modification, a surface of emission 114Bc of each of optical elements 114B1 to 114B5 is divided in the circumferential direction of the optical axis Ax into a plurality of segments. A diffusion lens element 114Bs is assigned to each of the segments. Each of the diffusion lens elements 114Bs is configured to diffuse internally reflected light having reached the diffusion lens element 114Bs in the circumferential direction of the optical axis Ax in order to emit the diffused light. Each of the diffusion lens elements 114Bs is formed with the conical surface forming the surface of emission 14Bc according to one or more embodiments of the present invention as a reference surface.

By adopting the configuration according to the first modification, it is possible to allow the prism portions 114Ap of the lens 114A to appear to brightly emit light discretely for each of the diffusion lens elements 114As, and to allow the surface of emission 114Bc of each of the optical elements 114B1 to 114B5 of the reflector 114B to appear to brightly emit light discretely for each of the diffusion lens elements 114Bs.

In the first modification, each of the diffusion lens elements 114Bs is formed with the conical surface forming the surface of emission 14Bc according to one or more embodiments of the present invention as a reference surface. This allows each of the diffusion lens elements 114Bs to diffuse light in the circumferential direction in order to emit the diffused light with reference to a direction in parallel with the optical axis Ax, which facilitates optical design.

Next, a second modification of one or more embodiments of the present invention is described.

Figure 6:
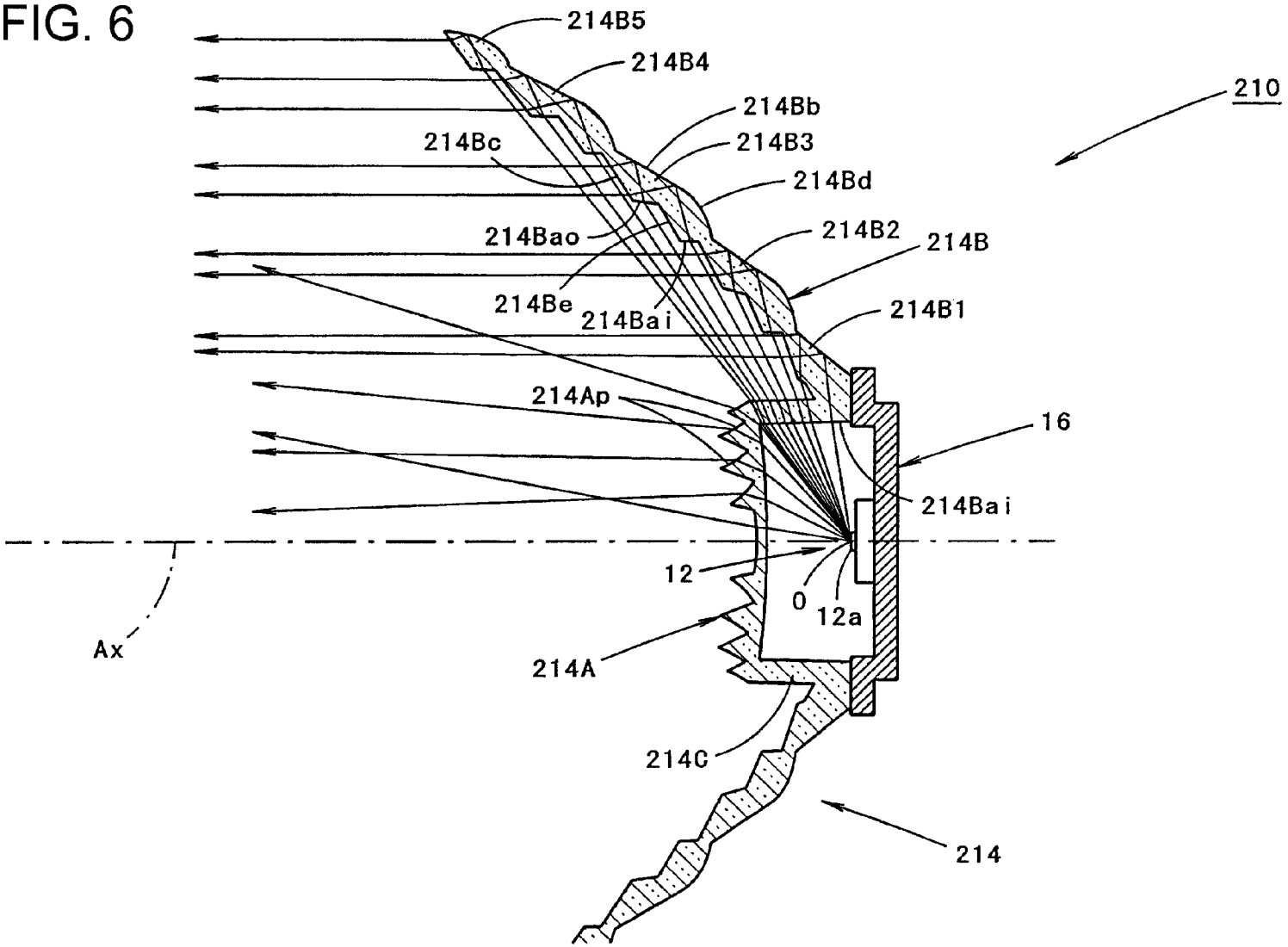
FIG. 6 is a front view showing a vehicular lamp according to a second modification of one or more embodiments of the present invention.

FIG. 6 is a side cross-sectional view showing a vehicular lamp 210 according to the second modification.

As shown in the drawing, the configuration of the vehicular lamp 210 is basically the same as that of the vehicular lamp 10 according to one or more embodiments of the present invention. However, the configuration of a translucent member 214 is different from the configuration of the counterpart according to one or more embodiments of the present invention.

That is, a lens 214A according to the second modification is different from the counterpart according to one or more embodiments of the present invention in number and shape of prism portions 214Ap formed on the front surface of the lens 214A so as to be coaxial with each other.

As with the reflector 14B according to one or more embodiments of the present invention, a reflector 214B according to the second modification includes five optical elements 214B1 to 214B5 disposed continuously in the radial direction of the optical axis Ax. Each of the four optical elements 214B1 to 214B4 on the inner circumferential side includes two surfaces of incidence 214Bai and 214Bao disposed at two locations so as to be stepped. In the optical element 214B1 positioned on the innermost circumferential side, the surface of incidence 214Bai on the inner circumferential side is formed by the inner circumferential surface of a cylindrical portion 214C.

In each of the four optical elements 214B1 to 214B4 on the inner circumferential side, the surface of incidence 214Bao on the outer circumferential side, a portion of a reflective surface 214Bb on the outer circumferential side, and a surface of emission 214Bc are formed to have the same relationship as in one or more embodiments of the present invention. Also, the surface of incidence 214Bai on the inner circumferential side, a portion of the reflective surface 214Bb on the inner circumferential side, and the surface of emission 214Bc are formed to have the same relationship as in one or more embodiments of the present invention. After the surface shape of the portion of the reflective surface 214Bb on the outer circumferential side is determined, the surface shape of the portion of the reflective surface 214Bb on the inner circumferential side is determined.

In each of the four optical elements 214B1 to 214B4, in order to form the light reflected by the reflective surface 214Bb into generally parallel light, the inclination angle of the surface of incidence 214Bao on the outer circumferential side and the inclination angle of the surface of incidence 214Bai on the inner circumferential side are different from each other, and the respective portions of the reflective surface 214Bb on the outer circumferential side and the inner circumferential side are formed by surfaces that are not continuous with each other.

In each of the four optical elements 214B1 to 214B4, a stepped portion 214Be is formed between the surface of incidence 214Bao on the outer circumferential side and the surface of incidence 214Bai on the inner circumferential side. The stepped portion 214Be is formed by a conical surface that shares a center axis and a vertex with the conical surface forming the surface of emission 214Bc.

Because the light reflected by the reflective surface 214Bb does not reach the stepped portion 214Be, the stepped portion 214Be does not emit light.

By adopting the configuration according to the second modification, it is possible to allow the optical elements 214B1 to 214B5 of the reflector 214B to appear to brightly emit light discretely with bright portions provided at relatively large intervals in the radial direction as viewed from the front of the lamp, with the entire area of the surface of emission 214Bc appearing to brightly emit light and the stepped portion 214Be not appearing to emit light.

The stepped portion 214Be of each of the optical elements 214B1 to 214B5 is formed with a conical surface, the vertex of which is a point in the proximity of the light emission reference point, as a reference surface. Thus, each stepped portion 214Be can be formed such that the light from the light-emitting chip 12*a* does not directly reach the stepped portion 214Be.

Next, a third modification of one or more embodiments of the present invention is described.

Figure 7:
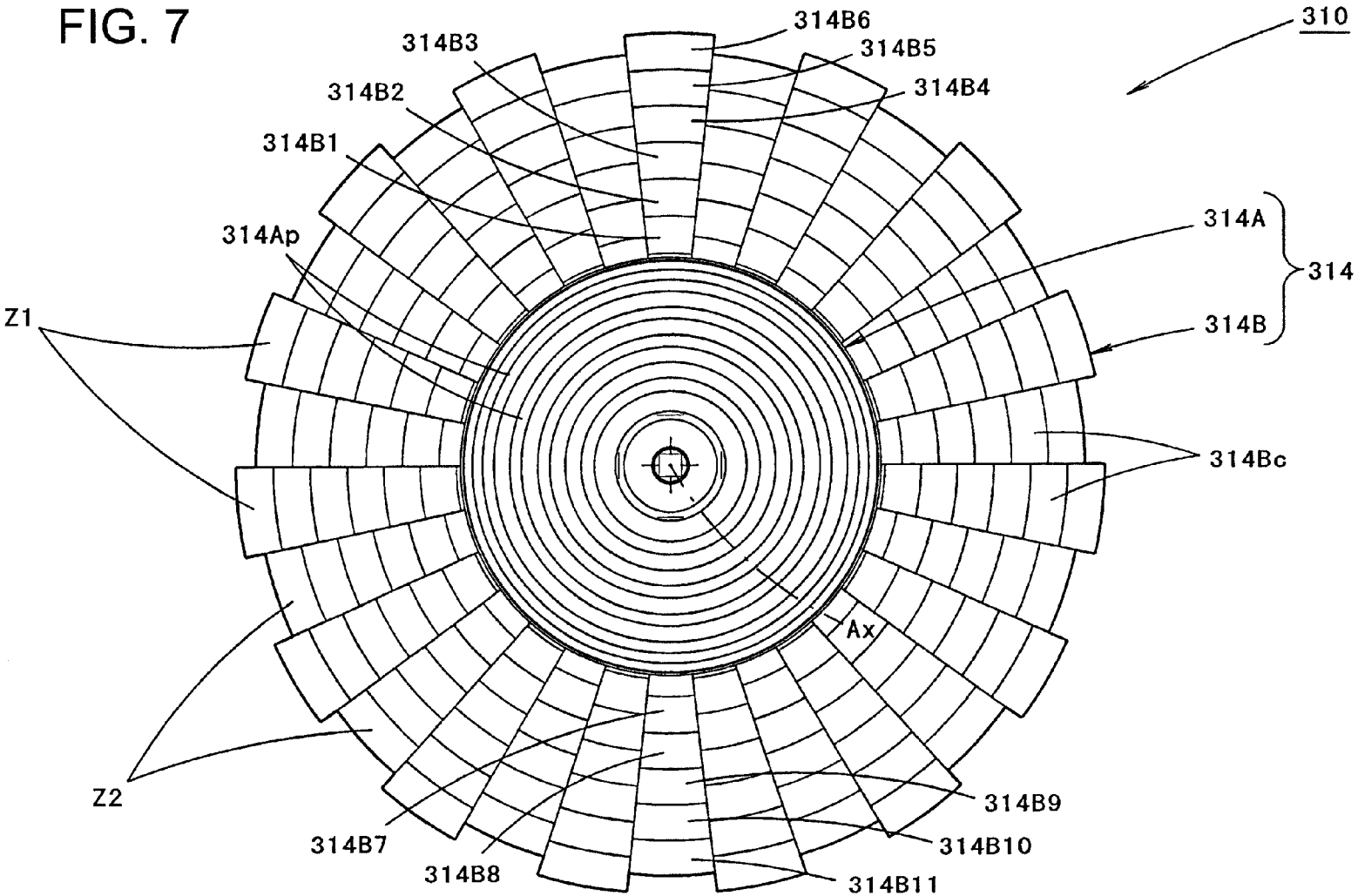
FIG. 7 is a front view showing a vehicular lamp according to a third modification of one or more embodiments of the present invention.
Figure 8:
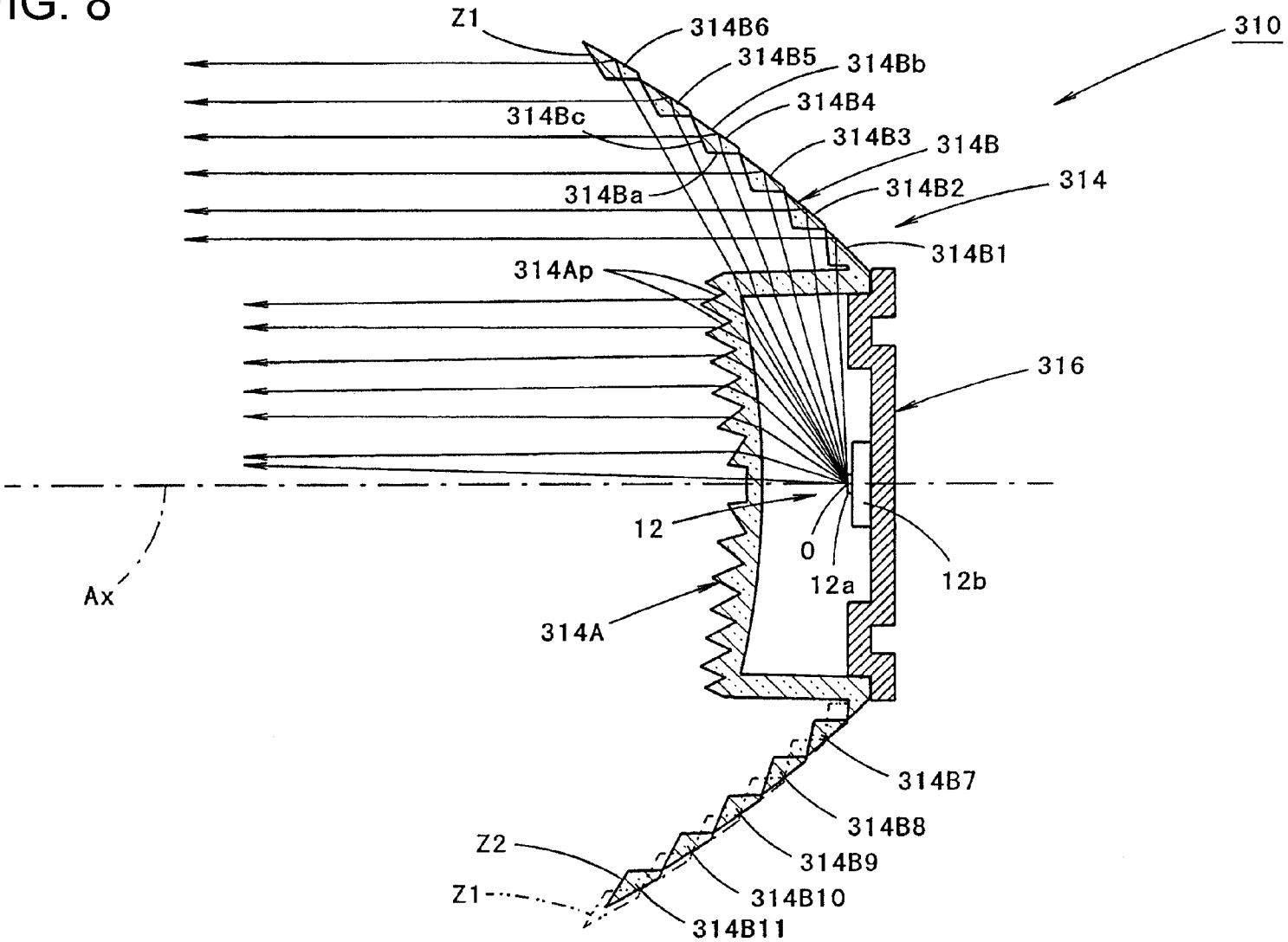
FIG. 8 is a side cross-sectional view showing the vehicular lamp according to the third modification shown in FIG. 7.

FIG. 7 is a front view showing a vehicular lamp 310 according to third the modification. FIG. 8 is a side cross-sectional view of the vehicular lamp 310.

As shown in the drawings, the configuration of the vehicular lamp 310 is basically the same as that of the vehicular lamp 10 according to one or more embodiments of the present invention. However, the configuration of a translucent member 314 is different from the configuration of the counterpart according to one or more embodiments of the present invention.

That is, a lens 314A according to the third modification is different from the counterpart according to one or more embodiments of the present invention in number and shape of prism portions 314Ap formed on the front surface of the lens 314A so as to be coaxial with each other.

The reflector 314B according to the third modification is divided into a plurality of areas in the circumferential direction of the optical axis Ax. The plurality of areas are formed by two types of areas Z1 and Z2 disposed alternately. Each of the areas Z1 includes six optical elements 314B1 to 314B6 disposed continuously in the radial direction of the optical axis Ax. Each of the areas Z2 includes five optical elements 314B7 to 314B11 disposed continuously in the radial direction of the optical axis Ax. The six optical elements 314B1 to 314B6 forming each of the areas Z1 and the five optical elements 314B7 to 314B11 forming each of the areas Z2 are displaced by generally half a pitch from each other in the radial direction.

Each of the six optical elements 314B1 to 314B6 forming each of the areas Z1 and the five optical elements 314B7 to 314B11 forming each of the areas Z2 includes a surface of incidence 314Ba, a reflective surface 314Bb, and a surface of emission 314Bc that are similar to those according to one or more embodiments of the present invention. In the third modification, the six optical elements 314B1 to 314B6 forming each of the areas Z1 are coupled to each other with a thickness of generally zero. Also, the five optical elements 314B7 to 314B11 forming each of the areas Z2 are coupled to each other with a thickness of generally zero. In FIG. 7, the area Z1 overlapping the area Z2 is indicated by a two-dotted broken line.

In the third modification, the shape of a supporting plate 316 that supports the reflector 314B is partly different from the counterpart according to one or more embodiments of the present invention.

In the third modification, the reflector 314B is divided into the plurality of areas Z1 and Z2 in the circumferential direction of the optical axis Ax, and the plurality of optical elements 314B1 to 31486 and 314B7 to 314B11 forming the plurality of areas Z1 and Z2, respectively, are displaced from each other in the radial direction between adjacent areas Z1 and Z2. Consequently, it is possible to form the reflector 314B as a single translucent member 314 even if the thickness of coupling portions between the optical elements 314B1 to 314B6 and between the optical elements 314B7 to 314B11 is set to be generally zero.

This allows the thickness of the translucent member 314 to be reduced to a minimum, which allows a reduction in material cost. By adopting such a configuration, the reflector 314B can be provided with a sophisticated appearance.

The numerical values provided as specifications in one or more embodiments of the present invention and the modifications are merely exemplary, and it is a matter of course that different values may be used appropriately.

While description has been made in connection with exemplary embodiments of the present invention, it will be obvious to those skilled in the art that various changes and modification may be made therein without departing from the present invention. It is aimed, therefore, to cover in the appended claims all such changes and modifications falling within the true spirit and scope of the present invention.

[Description of the Reference Numerals]

10, 110, 210, 310 VEHICULAR LAMP
12 LIGHT-EMITTING ELEMENT
12*a* LIGHT-EMITTING CHIP
12*b* SUBSTRATE
14, 114, 214, 314 TRANSLUCENT MEMBER
14A, 114A, 214A, 314A LENS
14Ap, 114Ap, 214Ap, 314Ap PRISM PORTION
14B, 114B, 214B, 314B REFLECTOR
14B1 to 14B5, 114B1 to 114B5, 214B1 to 214B5, 314B1 to 314B11 OPTICAL ELEMENT
14Ba, 214Bai, 214Bao, 314Ba SURFACE OF INCIDENCE
14Bb, 214Bb, 314Bb REFLECTIVE SURFACE
14Bc, 114Bc, 214Bc, 314Bc SURFACE OF EMISSION
14Bd CONNECTION SURFACE
14C, 214C CYLINDRICAL PORTION
16, 316 SUPPORTING PLATE

114As, 114Bs DIFFUSION LENS ELEMENT
214Be STEPPED PORTION
Ax OPTICAL AXIS
O CENTER OF LIGHT EMISSION
Z1, Z2 AREA

What is claimed is:

1. A vehicular lamp comprising:

a light source disposed on an optical axis extending in a front-back direction of the vehicular lamp; and a reflector that reflects forward light from the light source, wherein the reflector is formed by a translucent member comprising a plurality of optical elements disposed continuously in a radial direction of the optical axis;

wherein each of the optical elements comprises: a surface of incidence through which light from a light emission reference point in the light source is incident into the optical element, wherein the surface of incidence refracts the light into a direction away from the optical axis, a reflective surface which internally reflects forward the light which is incident into the optical element through the surface of incidence, and a surface of emission through which the light internally reflected by the reflective surface is emitted forward from the optical element;

wherein the reflective surface of each of the optical elements comprises a curved surface that allows generally an entirety of the light internally reflected by the reflective surface to reach the surface of emission of the optical element as substantially parallel light; and wherein the reflective surface of each of the optical elements is configured such that light internally reflected from an inner circumferential end edge of the reflective surface travels toward an inner circumferential end edge of the surface of emission of the optical element, and such that light internally reflected from an outer circumferential end edge of the reflective surface travels toward an outer circumferential end edge of the surface of emission of the optical element.

2. The vehicular lamp according to claim 1, wherein the surface of emission of each of the optical elements is formed with a conical surface, a vertex of which is a point in the proximity of the light emission reference point, as a reference surface.

3. The vehicular lamp according to claim 2, wherein the reflector is divided into a plurality of areas in a circumferential direction of the optical axis; and wherein the plurality of optical elements forming the plurality of areas are displaced from each other in a radial direction between adjacent areas.

4. The vehicular lamp according to claim 3, wherein a lens which transmits the light from the light source while deflecting the light is disposed in front of the light source;

wherein the lens is formed integrally with the reflector; and wherein a coupling portion between the lens and the reflector is formed as a cylindrical portion centered on the optical axis.

5. The vehicular lamp according to claim 2, wherein a lens which transmits the light from the light source while deflecting the light is disposed in front of the light source;

wherein the lens is formed integrally with the reflector; and wherein a coupling portion between the lens and the reflector is formed as a cylindrical portion centered on the optical axis.

6. The vehicular lamp according to claim 1, wherein the reflector is divided into a plurality of areas in a circumferential direction of the optical axis; and wherein the plurality of optical elements forming the plurality of areas are displaced from each other in a radial direction between adjacent areas.

7. The vehicular lamp according to claim 6, wherein a lens which transmits the light from the light source while deflecting the light is disposed in front of the light source;

wherein the lens is formed integrally with the reflector; and wherein a coupling portion between the lens and the reflector is formed as a cylindrical portion centered on the optical axis.

8. The vehicular lamp according to claim 1, wherein a lens which transmits the light from the light source while deflecting the light is disposed in front of the light source;

wherein the lens is formed integrally with the reflector; and wherein a coupling portion between the lens and the reflector is formed as a cylindrical portion centered on the optical axis.

9. A vehicular lamp comprising:

a light source disposed on an optical axis extending in a front-back direction of the vehicular lamp; and a reflector that reflects forward light from the light source, wherein the reflector is formed by a translucent member comprising a plurality of optical elements disposed continuously in a radial direction of the optical axis;

wherein each of the optical elements comprises: a surface of incidence through which light from a light emission reference point in the light source is incident into the optical element, wherein the surface of incidence refracts the light into a direction away from the optical axis, a reflective surface which internally reflects forward the light which is incident into the optical element through the surface of incidence, and a surface of emission through which the light internally reflected by the reflective surface is emitted forward from the optical element;

wherein the reflective surface of each of the optical elements comprises a curved surface that allows generally an entirety of the li ht internall reflected b the reflective surface to reach the surface of emission of the optical element as substantially parallel light;

wherein the reflector is divided into a plurality of areas in a circumferential direction of the optical axis; and wherein the plurality of optical elements forming the plurality of areas are displaced from each other in a radial direction between adjacent areas.

10. The vehicular lamp according to claim 9, wherein a lens which transmits the light from the light source while deflecting the light is disposed in front of the light source;

wherein the lens is formed integrally with the reflector; and wherein a coupling portion between the lens and the reflector is formed as a cylindrical portion centered on the optical axis.

* * * * *